US009610485B2

(12) United States Patent
Lewter

(10) Patent No.: US 9,610,485 B2
(45) Date of Patent: Apr. 4, 2017

(54) GOLF BAG CLAMPING APPARATUS

(71) Applicant: Frederick Ray Lewter, Gulf Breeze, FL (US)

(72) Inventor: Frederick Ray Lewter, Gulf Breeze, FL (US)

(73) Assignee: A BETTER WAA, INC., Gulf Breeze, FL (US)

( * ) Notice: Subject to any disclaimer, the term of this patent is extended or adjusted under 35 U.S.C. 154(b) by 0 days.

(21) Appl. No.: 14/298,565

(22) Filed: Jun. 6, 2014

(65) Prior Publication Data

US 2014/0360901 A1 Dec. 11, 2014

Related U.S. Application Data

(60) Provisional application No. 61/832,002, filed on Jun. 6, 2013.

(51) Int. Cl.
*A63B 55/00* (2015.01)
*A63B 55/50* (2015.01)

(52) U.S. Cl.
CPC ..... *A63B 55/408* (2015.10); *A63B 55/50* (2015.10); *A63B 2225/09* (2013.01)

(58) Field of Classification Search
CPC ..... A63B 55/00; A63B 55/408; A63B 55/40; A63B 55/60; A63B 55/50; A64B 55/40; A64B 55/60
USPC ..... 206/315.3; 224/274, 918.919; 248/503; 280/DIG. 5, DIG. 6
See application file for complete search history.

(56) References Cited

U.S. PATENT DOCUMENTS 1,815,024 A * 7/1931 Foster ..... A63B 71/0672 273/148 R
D156,987 S * 1/1950 Newton ..... D8/395
2,786,693 A * 3/1957 Ayers ..... B62B 5/00 280/13
4,449,310 A * 5/1984 Kline ..... A63B 71/0672 206/315.3
5,332,090 A * 7/1994 Tucker ..... A63B 55/408 206/315.3
5,573,211 A * 11/1996 Wu ..... B62B 1/06 248/230.8
5,647,568 A * 7/1997 Nettles ..... A45F 5/04 211/16
5,671,842 A * 9/1997 Jaworski ..... A63B 55/00 206/315.3

(Continued)

*Primary Examiner* — Sue A Weaver
(74) *Attorney, Agent, or Firm* — Lazaris IP

(57) ABSTRACT

A golf bag clamp apparatus comprises an elongated body having front and back side members configured to conform to specific features of a surface of a golf bag. The clamp apparatus is an accessory that is added to golf bags to allow any golf bag to be safely and securely transported on any golf cart configuration. The clamp apparatus is molded so that the elongated body forms a member bent at an upper portion, with one or more curvatures in the elongated body to adhere to contours of a golf bag so that no damage occurs when the golf bag is secured to a golf cart. Angled portions of the front side have recessed cavities within which a strap assembly is coupled to the clamp apparatus to enable coupling of a golf bag to one or more fixed members of a golf cart. The strap assembly may also be adhered to one of the side members to enable coupling of a golf bag to the one or more fixed members of the golf cart.

11 Claims, 6 Drawing Sheets

(56) References Cited

U.S. PATENT DOCUMENTS

| | | | | |
|---|---|---|---|---|
| 7,337,898 | B2 | 3/2008 | Lewter | |
| 8,146,740 | B2 * | 4/2012 | Tan | A63B 55/408 190/115 |
| 2005/0082184 | A1 | 4/2005 | Lewter | |
| 2006/0011682 | A1 * | 1/2006 | Christensen | B60R 7/08 224/274 |
| 2008/0109976 | A1 * | 5/2008 | Sanabia | A45F 5/02 15/106 |
| 2008/0135431 | A1 * | 6/2008 | Tan | A63B 55/00 206/315.7 |
| 2011/0070967 | A1 * | 3/2011 | Davis, Jr. | A63B 55/10 473/282 |

* cited by examiner

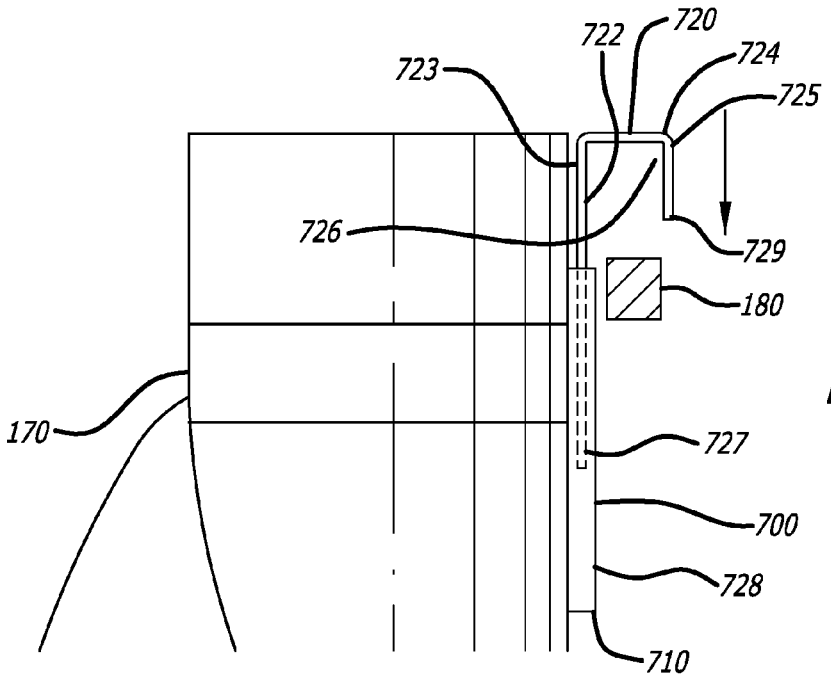
FIG. 9
FIG. 10
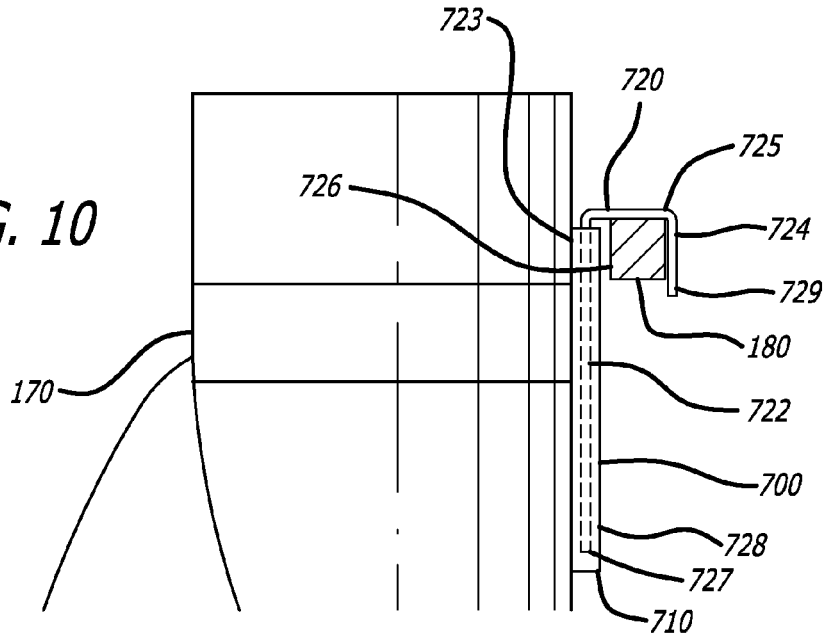

GOLF BAG CLAMPING APPARATUS

CROSS-REFERENCE TO RELATED PATENT APPLICATIONS

This patent application claims priority to U.S. provisional application 61/832,002, filed on Jun. 6, 2013, the contents of which are incorporated in their entirety herein.

FIELD OF THE INVENTION

The present invention relates to an apparatus for securing a golf bag to a golf cart. Specifically, the present invention relates to an apparatus in the form of a clamp device or strap arrangement that can be added to any conventional golf bag as an accessory or as part of the bag's manufacture to securely affix the golf bag to a golf cart. The present invention may include an adjustable strap mechanism so that the clamp is universally applicable to secure any golf bag to any golf cart.

BACKGROUND OF THE INVENTION

There are many existing ways to transport a golf bag in a golf cart. Most golf carts in use today have a strap assembly positioned at the back of the cart that wraps around a golf bag to secure it to a shallow-well storage shelf or other receptacle located at the rear of the cart. These, however, are not very secure, and it is often the case that bags and/or their contents experience significant movement and potential damage when one uses such a strap assembly integrated with a golf cart. U.S. Patent Application No. 2005/0082184 discloses one method of securing a golf bag to a golf cart, in which a strap assembly is sewn or otherwise affixed directly to a golf bag, permitting a user to removably couple the golf bag to a portion of the golf cart. Despite this, however, there is no device in existence which permits a user to removably couple golf bags of any size to any golf cart configuration and which is still a removable accessory or part of a removable accessory, and specifically designed to provide adequate protection to prevent damage to golf bags and the contents thereof. It is therefore one objective of the present invention to provide a product which is an after-market or add-on accessory that does not require extra components permanently affixed during manufacturing directly onto a golf bag.

Similarly, there are many types of clips and clamps in the marketplace. Clips and clamps that are machined to secure items together in a high-torque environment and/or items of substantial size or weight have been available for many years. However, none of these are suitable for securing a golf bag to a golf cart because they are not designed with the specific attributes of golf bags and golf clubs in mind, nor or they are they adjustable to accommodate different types of golf carts. Devices such as industrial-use, quick jaw spring clamps provide too much pressure, raising the possibility of damage to golf bags, and do not permit adjustment when coupling the golf bag to a golf cart. One reason no one has previously considered to apply or modify such existing clamps or clips to a golfing environment is because golf bags and golf carts were largely of uniform design, so golf cart baskets provided limited yet adequate support for the short term uses of many casual golfers. However, with advances in golf bag and golf club technology, the golf industry has seen a dramatic increase in the average golfer's investment in their equipment, and the need to maximize protection for their investments in such items. Also, specialization in golf bag design has come to the point where a clamp design that is easily compatible with any golf bag has become advantageous, as there are many different existing types and sizes of golf bags available today. It is therefore one objective of the present invention to provide a means for securing a golf bag to a golf cart with an apparatus that has been machined with appropriate application of tension and force to adequately protect golfer equipment.

Similarly, users of golf bags that have a telescoping mechanism such as that disclosed in U.S. Patent Application No. 2005/0082184 and U.S. Pat. No. 7,337,898 have no way of operating such a mechanism when a golf bag is secured by a cart-provided strap mechanism. Golfers must remove such a golf bag to gain access to the contents that the telescoping mechanism permits. It is therefore another objective of the present invention to provide a means for securely coupling a golf bag to a golf cart in such a way that still permits users to have full access to the contents of the bag while it is secured to the cart, regardless of the type golf bag used.

BRIEF SUMMARY OF THE INVENTION

The present invention is clamp mechanism that includes an apparatus that affixes to an upper portion of golf bag at the outer rim of its open end and extending, at least in part, along an inner surface of the golf bag, and/or through a vertical pocket, loop, or ring, and opposite an storage appendage commonly found on an outer surface of most golf bags. The clamp mechanism incorporates contours in the form of curves machined into front and back members, and may include a strap for adjusting tension in relation to fittings of a golf cart so that clamp is universally applicable to any golf bag and any golf cart. The clamp mechanism may take many different forms, such; as for example, a clothes-pin-style clip.

In one embodiment of the present invention, a clip assembly for a golf bag comprises a member molded to form a back side and an opposing front side that is slightly elongated relative to the back side, with a closed end formed at upper portions of the front and back sides, and an open end formed at lower portions of the front and back sides. The member has angular sections on each of the front and back sides that include a top angled portion and a bottom angled portion along the front side, and a back angled portion along at least a section of the back side, the front and back sides each being tapered at the open end and having a tension formed between them to accommodate insertion, secure placement, and removal of the member relative to a golf bag. The clip assembly also includes recessed cavities positioned within weighted, or thicker, portions in the top and bottom angled portions on the front side having a thickness greater than the upper portion and the lower portion of the back side, so that a first recessed cavity is formed within a top angled portion of the front side, and a second recessed cavity is formed within a bottom angled portion of the front side, each of the top and bottom angled portions also having 1) an outer portion partially enclosing each recessed cavity, 2) a plurality of teeth extending out angularly near an end of each outer portion and towards each weighted portion, 3) an inner aperture within each weighted portion, and 4) an open side within which a securing portion of a strap assembly is insertable and lockable therein.

Another embodiment of the present invention discloses a golf bag clamping assembly that comprises a first member molded to form a back side and an opposing front side, with a closed end formed at upper portions of the front and back sides, and an open end formed at lower portions of the front and back sides, the front and back sides each being tapered at the open end and having a tension formed between the front and back sides at multiple points along each of the front and back sides to accommodate insertion, secure placement, removal of the member relative to a golf bag, and prevent lateral and vertical movement of the apparatus while the member is positioned in the golf bag. The back side is positioned on an inside of a golf bag and the front side is positioned on an outside of a golf bag with the closed end positioned over an outer rim of the golf bag when the first member is inserted into the golf bag. The clamping assembly also comprises a second clip member molded to form a cart side and an opposing mating side, with a closed end formed at upper portions of the cart and mating sides, and an open end formed at lower portions of the cart and mating sides, the mating side configured to slide in and out of a recessed portion forming a track on the front side of the first clip member to accept the mating side, so that the mating side of the second clip member is removably and adjustably positionable relative to the front side of the first clip member. The back side of the first member also includes one or more curved portions that create one or more points of pressure between the back side and an inside surface of the golf bag, the points of pressure and the tension enabling the first member to securely fit over the outer rim of the golf bag.

In another embodiment, the present invention is an apparatus comprising a clipping assembly having a member molded to form a back side and an opposing front side that is slightly elongated relative to the back side, with a closed end formed at upper portions of the front and back sides, and an open end formed at lower portions of the front and back sides, the front and back sides each being tapered at the open end and having a tension formed between them to accommodate insertion, secure placement, and removal of the member relative to a golf bag. The apparatus includes a plurality of curved portions formed in the member that include a front curved portion along a section of the front side and a back curved portion along a section of the back side to accommodate one or more contours of a golf bag and create one or more points of pressure at inside and outside surfaces of the golf bag. The apparatus also includes a strap assembly coupled to the clamp apparatus in at least one position along an outer surface of the front side, the strap assembly having a coupling portion and an adjustment mechanism allowing the strap assembly to be opened, closed and adjusted relative to one or more fixed members of a device to which the golf bag is coupled.

Other embodiments, features and advantages of the present invention will become apparent from the following description of the embodiments, taken together with the accompanying figures, which illustrate, by way of example, the principles of the invention.

BRIEF DESCRIPTION OF THE SEVERAL VIEWS OF THE DRAWINGS

The accompanying drawings, which are incorporated in and constitute a part of this specification, illustrate several embodiments of the invention and together with the description, serve to explain the principles of the invention.

FIG. 9 is a side view of an assembly for securing a golf bag to an attachment member of a golf cart, showing an uncoupled state, according to yet another embodiment of the present invention; and FIG. 10 is a side view of the assembly of FIG. 9 showing a coupled state.

DETAILED DESCRIPTION OF THE INVENTION

In the following description of the present invention reference is made to the accompanying figures which form a part thereof, and in which is shown, by way of illustration, exemplary embodiments illustrating the principles of the present invention and how it is practiced. Other embodiments will be utilized to practice the present invention and structural and functional changes will be made thereto without departing from the scope of the present invention.

Figure 1:
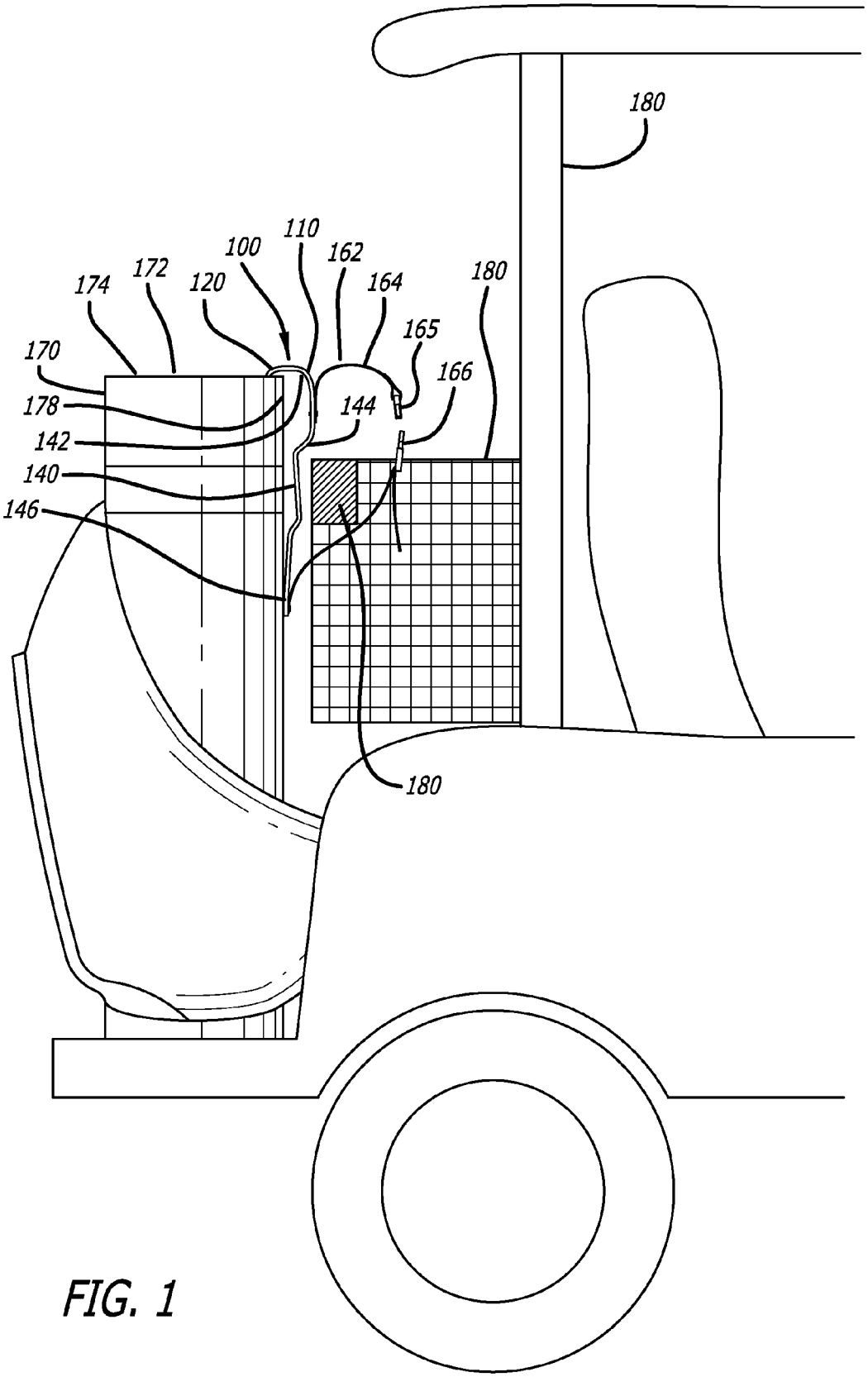
FIG. 1 is a side view of an assembly for securing a golf bag to one or more attachment members of a golf cart according to the present invention.

The present invention discloses a clamping mechanism configured to enable a golf bag to be securely affixed to a golf cart. FIG. 1 is a side view of such a clamping mechanism, which is embodied in an apparatus 100 having an elongated body 110 that is curved to form a closed upper end 120 and open lower end 130. The curved elongated body 110 also forms a front side 140 and a back side 150 that is shorter than the front side 140, with the upper end 120 forming, as noted, a closed end between the front side 140 and back side 150 at top portions 142 and 152, respectively, of each of the front side 140 and back side 150.

Figure 2:
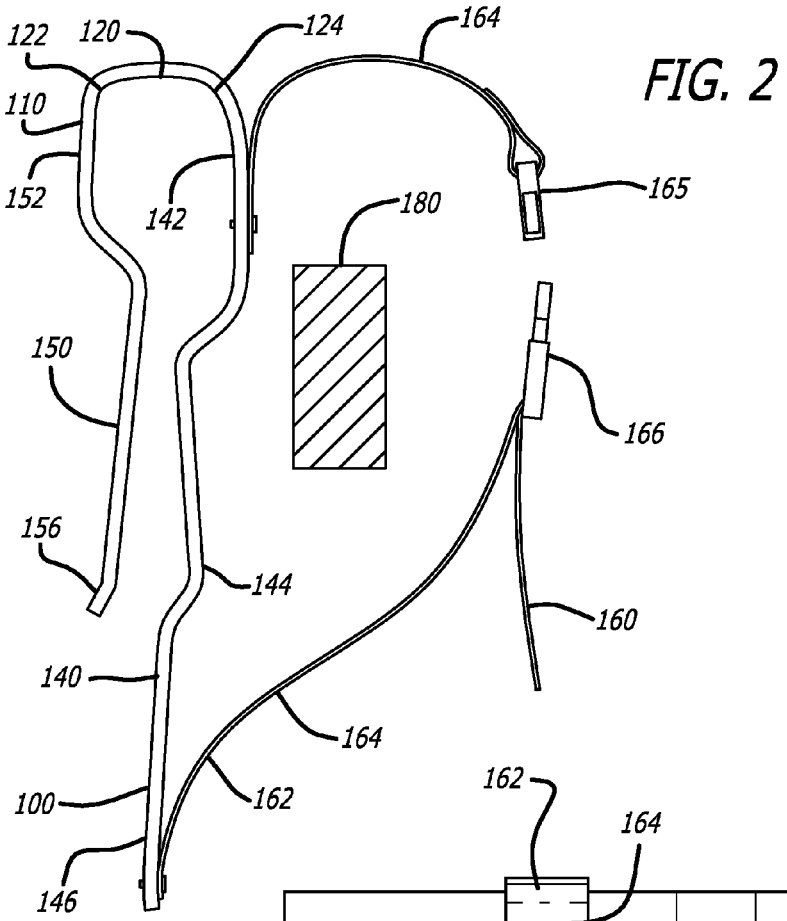
FIG. 2 is a side view of the assembly of FIG. 1.

The apparatus 100 affixes to a golf bag 170 at an open portion 172 thereof at an outer rim 174, as shown in the plan view of FIG. 2. The apparatus 100 is affixed to the golf bag 170 opposite to and/or away from outer storage appendages commonly found on most golf bags, and may also be opposite to a handle also included on most golf bags. The apparatus 100 may also be designed to fit over a hinged section of golf bags 170 that have fold out legs 175 (such bags are commonly known as "stand bags"). The front side 140 of the apparatus runs substantially down a center spine 176 on an outside surface 178 of the golf bag 170 and between the legs 175 of golf bags 170 that have such fold-out legs 175, and may include an angled and/or curved section on the front side 140 to fit over said fold-out legs 175. The upper end 120 of the apparatus 100 forming the closed end is curved on inner and outer sides 122 and 124 thereof to accommodate the padded interior rings that are on most golf bags 170 to reduce the shaft wear on golf club equipment as they rub against the golf bag 170.

Figure 3:
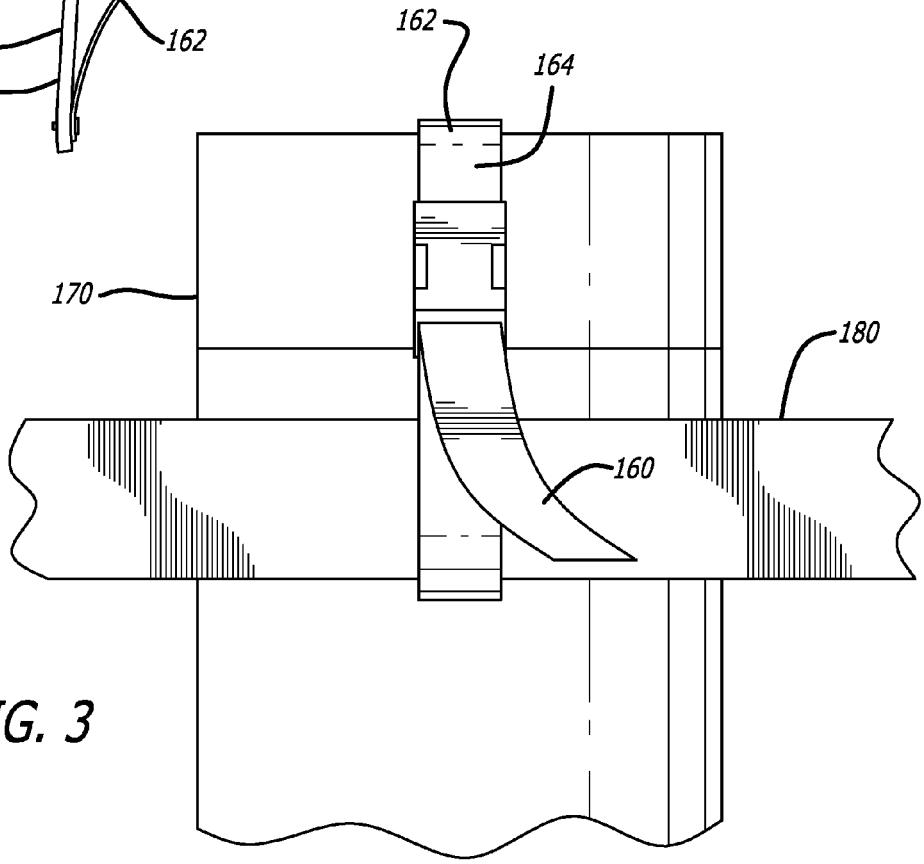
FIG. 3 is a close-up view showing the assembly of FIG. 1 and FIG. 2 deployed to secure a golf bag to an attachment member of a golf cart.
Figure 4:
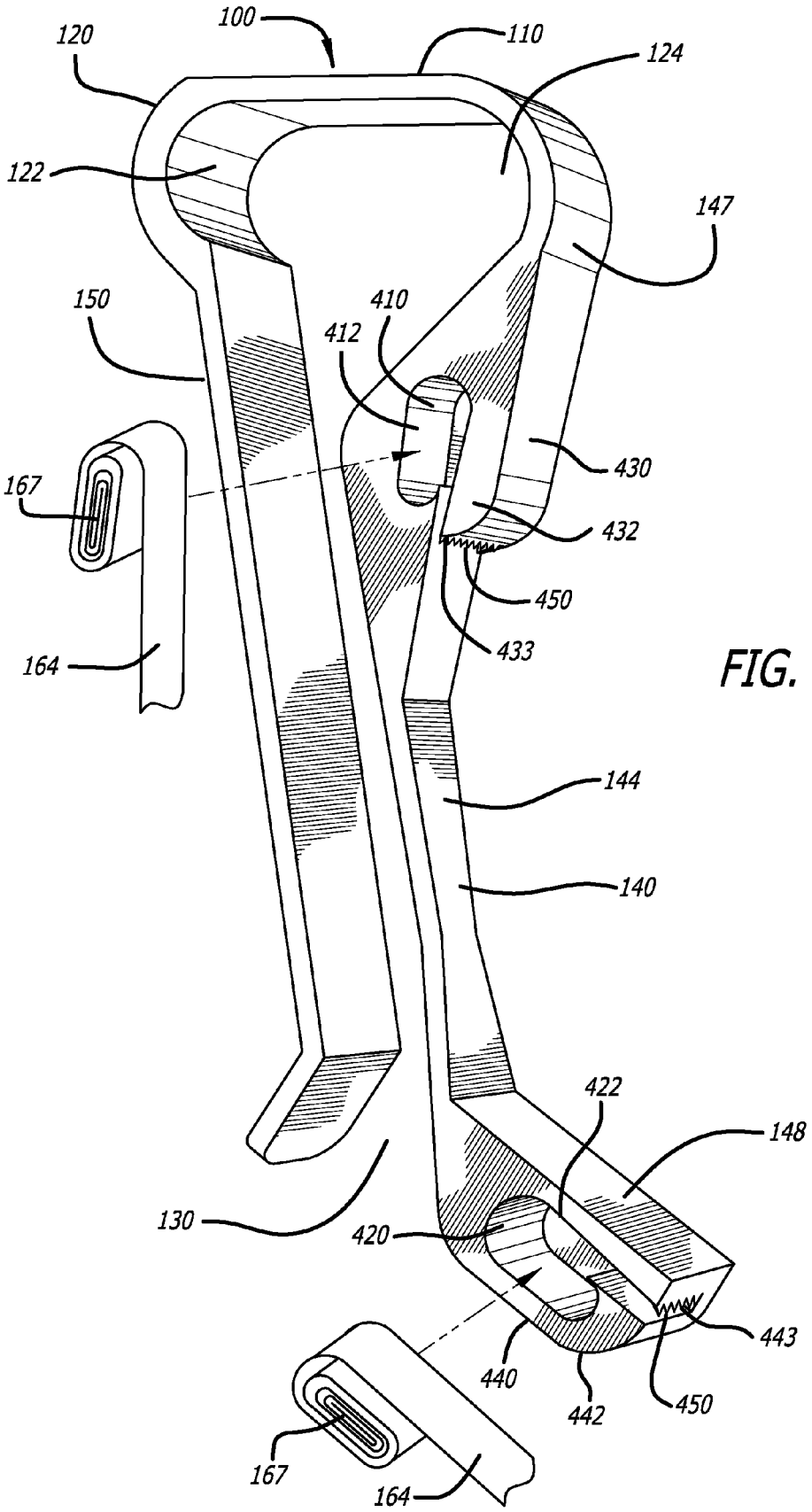
FIG. 4 is a perspective view of an assembly according to one aspect of the present invention.

An adjustment mechanism 160 may be affixed to an outer surface 144 of the front side 140 as shown in FIGS. 1 and 2, or coupled via upper and lower recessed cavities 410 and 420 within the front side 140 as shown in FIG. 4. Regardless, the adjustment mechanism 160 is an integrated, adjustable strap assembly 162 that, as noted above, may be either affixed to the apparatus 100 on a cart side thereof, which is the front side 140 of the apparatus 100, at is outer surface 144, or separately coupled thereto via recessed cavities molded into the front side 140 as shown in FIG. 4. The adjustable strap assembly 162 provides the ability for the apparatus 100 to accommodate a greater number of golf cart basket/bar mounting configurations. The design of the adjustable strap assembly 162 allows a user to thread one or more straps 164 through basket slits or holes (on a golf cart basket) or around one or more bars or other attachment members on a golf cart as shown in FIG. 1 and FIG. 3, respectively, providing a much wider range of secure mounting options, and preventing lateral movement of the golf bag 170 during golf cart operation. FIG. 3 is a close-up view showing the apparatus 100 with the adjustable strap assembly 162 deployed to secure a golf bag 170 to a golf cart. The adjustable strap assembly 162 may also act as a separate carrying handle for the golf bag 170, as noted further below.

The front side 140 and back side 150 of the apparatus 100 are manufactured such that they are molded to create tension and maintain a specific distance between them, in particular between the bottom portions 146 and 156, respectively, of the front side 140 and back side 150. The tension induced in those bottom portions 146 and 156 provides additional support when the golf bag 170 is affixed to a golf cart, in addition to the benefits of force distribution from shapes formed from the curvatures in the front side 140 and back side 150. Additionally, the front and back sides may each include a plurality of angled and/or curved portions to accommodate one or more contours of a golf bag and create one or more points of pressure at inside and outside surfaces of the golf bag.

The one or more straps 164 of the adjustable strap assembly 162 are comprised of, in one embodiment, a male portion 165 and a female portion 166. In FIG. 1, the adjustable strap assembly 162 itself is affixed in a first place to an upper part 147 of the outer surface 144 of the front side 140 of the apparatus 100, and in a second place to a lower part 148 of the outer surface 144 of the front side 140 of the apparatus 100. The male portion 165 of the strap 164 extends from one of the upper part 147 or the lower part 148 of the outer surface 144, and the female portion 166 of the strap 164 extends from the other of the upper part 147 and the lower part 148 of the outer surface 144. One or both of the male portion 165 and female portion 166 may have a further adjustment portion 168 that allows a length of the male portion 165 or the female portion 166 to be increased to accommodate different golf bag sizes and designs and/or different golf cart designs.

As shown in FIG. 4, the front side 140 includes an upper recessed cavity 410 and a lower recessed cavity 420, each positioned respectively at or near upper and lower parts 147 and 148 of the front side 140. Each of the upper and lower cavities 410 and 420 are located within weighted portions 430 and 440 of the front side 140 at or near the top and bottom portions 142 and 146, respectively. The upper and lower recessed cavities 410 and 420 are designed to accommodate slide-in fastening mechanisms 167 such as the end portions of the straps 164, which may for example take the form of folded, rolled or bunched material. These slide-in fastening mechanisms 167 are insertable and lockable into the upper and lower recessed cavities 410 and 420 on each of the top and bottom portions 142 and 146 of the front side 140.

Each slide-in fastening mechanism 167 is inserted through open ends 412 and 422 of the recessed cavities 410 and 420, respectively, and locked as indicated herein. The adjustable strap assembly 162 is then threaded through the one or more attachment members 180 on a golf cart (such as for example a basket or bar), and the male portion 165 and the female portion 166 are then coupled together to secure the golf bag 170 to the one or more attachment members 180 using the apparatus 100.

The upper and lower recessed cavities 410 and 420 may each also include an inner aperture 414 and 424, so that when a slide-in mechanism 167 is inserted into one of the recessed cavities 410 and 420, a user maneuvers the slide-in fastening mechanism 167 upwards and then downwards, so that a portion of the folded, rolled, or bunched material is positioned into the inner aperture 412 and 422. Each weighted portion 430 and 440 includes an outer portion 432 and 442 with one or more serrated teeth 450 positioned at or proximate to ends 433 and 443 thereof. The one or more serrated teeth 450 are angled relative to the directional plane of the outer portions 432 and 442 and towards a body 434 and 444 of each weighted portion 430 and 440, so that the one or more serrated teeth 450 form a small opening between the ends 433 and 444 of the outer portions 432 and 442 and the rest of the body 434 and 444 of each weighted body 430 and 440. Any angles suitable for securing the straps 164 between the outer portions 432 and 442 and the body 434 and 444 of the weighted portions 430 and 440 may be used. For example, the one or more serrated 450 teeth may be angled at 45 degree angles, 90 degree angles, or any other angles relative to the directional plane of the outer portions 432 and 442. Additionally, one or more small gaps may separate the one or more serrated teeth 450 from each other to provide pressure at different points to further secure the folded, rolled or bunched material of the slide-in fastening mechanisms 167 of the straps 164 within each of the upper and lower recessed cavities 410 and 420. Such a gap may, for example, form a centimeter slot between teeth 450.

It is to be noted that many other configurations are possible to secure the slide-in fastening mechanisms 167 within the weighted portions 430 and 440 of the upper and lower recessed cavities 410 and 420. For example, the one or more serrated teeth 450 may each be positioned at a different angle, and may also be positioned substantially facing each other and various angles, rather than all being positioned in the direction of the body 434 and 444 of each weighted portion 430 and 440. Also, the slide-in fastening mechanisms 167 may have any size sufficient for them to be secured by the one or more serrated teeth 450.

Additional design features of the present invention may be included in one or more embodiments. For example, the bottom portions 146 and 156 of the front and back sides 140 and 150 (at the lower end 130 thereof opposite to the curved upper end 120 of the elongated body 110 of the apparatus 100) may be tapered to allow for easy sliding as the apparatus 100 is inserted into and removed from a golf bag 170. Additionally, and regardless of whether the apparatus 100 is configured as in FIG. 1 or FIG. 4, the adjustable strap assembly 162 may be arranged so that it is coupled to the front side 140 of the apparatus 100 at top 142 and bottom 147 positions of the outer surface 144 so as to create a length of travel substantially equal to the length of the front side 140. In one embodiment, this length of travel is 9"—and when combined with the length of a male portion 165 of the strap 164, allows for a much longer mounting range to accommodate everything from junior-sized golf bags to touring golf bags and in every conceivable cart configuration. For example, where the male portion 165 of the strap 164 is expandable to 12", the total mounting range of the strap assembly is 17".

The one or more straps 164 are intended to utilize materials that are capable of withstanding heavy use and excessive force from movement. For example, the adjustable strap assembly 162 may include woven, nylon strap portions riveted to a plastic clip structure to ensure effective adherence under stress from being pulled in multiple directions, depending on the mounting configuration. Plastic materials utilized in the present invention are contemplated to be durable and weather resistant, easy to mold, and inexpensive to manufacture. The rolled or bunched portions 167 may be formed of slightly thicker material or amounts of material than the rest of the straps 164.

The length of the front side 140 of the apparatus 100 is slightly longer than the back side 150 to provide greater stability to a golf bag 170 when coupled to a golf cart. This longer length of the front side 140, contemplated in one embodiment to be approximately 9" but not limited to any one length specified herein, permits accommodation of a wide range of thicknesses and materials used in manufacture of golf bags 170. The longer length of the front side 140 of the apparatus 100 and the bridged, curved section at the upper end 120 are also contemplated to distribute downward torque and inward pressure to the golf bag 170 over a wider area thereof to avoid damaging thin nylon exteriors common with lightweight stand bags. Distribution of these forces avoids specific stress points and increases strength coupling between the golf bag 170 and the golf cart. Similarly, the upper and lower weighted portions 430 and 440 also contributes to distribution of forces as well as to providing support for the slide-in fastening mechanisms formed by the rolled or bunched portions 168.

In one embodiment of the present invention, the elongated body 110 of the apparatus 100 is formed from a material capable of withstanding application of a large lateral torque, such as for example aluminum, and a semi-flexible plastic adjustment mechanism 160 in the form of the adjustable strap assembly 162. The elongated body 110 includes the upper end 120 with a space between the front side 140 and the back side 150 that is substantially larger at the upper end 120 than at the lower end to accommodate rims 174 of golf bags 170 as noted above. Between its top and bottom portions 152 and 156, the back side 150 of the elongated body 110 is a substantially straight member, while the front side 140 includes the bridged, curved section resulting from a plurality of curvatures molded for the purpose of creating contour to accommodate features of golf bags 170 to which they will be applied, and in a further aspect, to create tension at different points along the length of the front and back sides 140 and 150.

The adjustable strap assembly 162 and the front side 140 of the elongated body 110 of the apparatus 100 may combine to act as a carrying handle. In a closed, or locked configuration, a user may grab the adjustable strap assembly 162 and pick up, carry, or put down a golf bag 170. Because the adjustable strap assembly 162 is coupled to the outer surface 144 of the front side 140 of the elongated body 110 in at least two places (preferably near a top 142 of the front side 140 and near a bottom 146 of the front side 140) force can be distributed at two points to enable support when the golf bag 170 is manipulated in this manner. The adjustable strap assembly 162, combined with the biased tension between the front and back sides 140 and 150, enables use of the present invention as a carrying handle.

The adjustable strap assembly 162 may utilize different mechanisms capable of securing a golf bag 170 to a golf cart. For example, side-release snap buckles may be employed to provide easy adjustment and secure fastening, and in particular allow easy release of the adjustable strap assembly 162 with one hand. Other embodiments of the present invention may incorporate a hook-and-loop structure such as Velcro, one or more buckles or keepers, one or more metal or plastic snaps, or anything else capable of producing of locked or secured mechanism. It is therefore contemplated that the present invention is not to be limited by any one type of mechanism of which the adjustable strap assembly 162 is comprised.

Many other variations of the apparatus 100 of the present invention are contemplated. The present invention, as noted above, may also be considered as a method of safely securing any type of golf bag to any golf cart configuration. In that regard, the present invention may comprise a clothes-pin-style clip configured to be wide enough to bind the open-end rim 174 of a golf bag 170 to a cart mounting bar. The apparatus 100 may further be embodied as a clip with a counter-wound spring at or near a top thereof that allows a user to open and close the clip by grabbing ends and squeezing to open the first and second sides about the counter-wound spring. The apparatus 100 may comprise an elongated body 110 that is wider at least at the curved upper end 120 relative to the front side 140 and back side 150 to enable the apparatus 100 to act as a clip that couples a golf bag 170 directly to a golf cart without the need for an adjustment mechanism 160. In such an embodiment, the front and back sides 140 and 150 may be configured to extend a longer distance from the curved upper end 120 and from the top, open end of a golf bag 170 than embodiments with an adjustable strap assembly 162 to maintain tensile forces between them when utilized to couple the golf bag 170 to the golf cart. The extended width of the elongated body 110, and the extension of the front side 140 and back side 150 relative to the side of the golf bag 170, together act to provide sufficient strength and stability when coupled directly to one or more fixed members of the golf cart so that no adjustment mechanism 160 is needed. In still another embodiment, the golf bag 170 may have a pocket, ring(s), or loop(s) affixed to its outer surface through which the front side 140 of the apparatus 100 may be positioned when applied to a golf bag 170. The pocket may be a closed pocket with one end or open on two sides, and the rings(s) and loop(s) may be formed of a nylon fabric or made of high-strength plastic or metal. Regardless of whether this embodiment employs pockets, rings, or loops, it is intended that such items act as an extra stabilizing mechanism for the apparatus 100 when applied to the golf bag 170 so as not to damage the golf bag 170 or its contents when the apparatus 100 is applied in the manner described herein. Additionally, by employing pockets, loops, and rings, the apparatus 100 remains secured in place when applied to the golf bag 170, reducing the wear and tear on the apparatus 100 and minimizing the chance of the apparatus 100 being bent out of shape while in use.

Figure 5A:
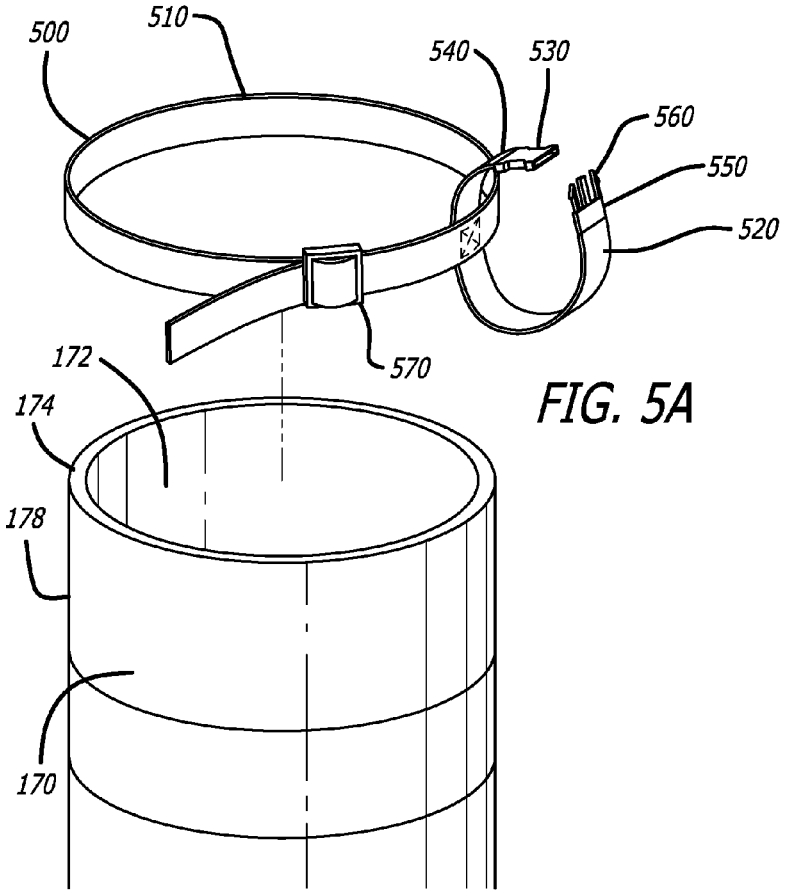
FIG. 5A is a perspective view of an assembly for securing a golf bag to an attachment member of a golf cart according to another embodiment of the present invention.
Figure 5B:
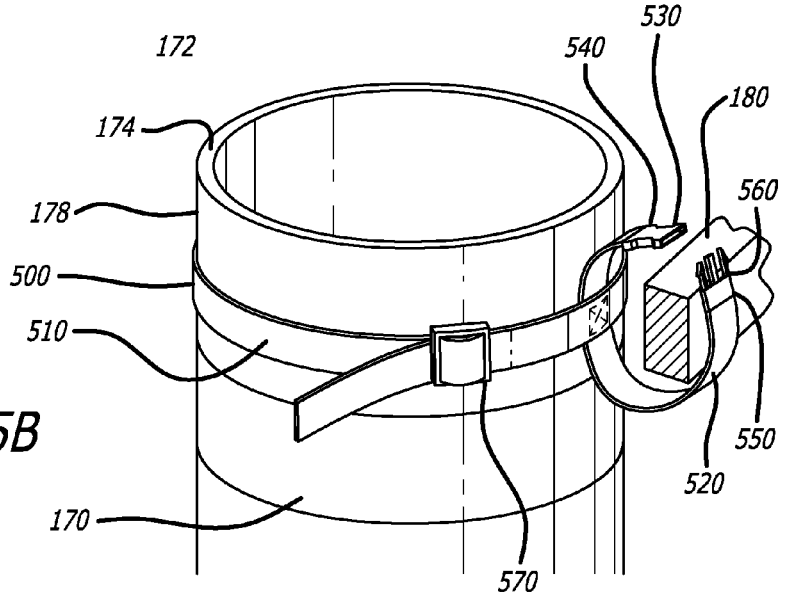
FIG. 5B is another perspective view of the assembly of FIG. 5A for securing a golf bag to a golf cart according to still another embodiment of the present invention.

FIG. 5A and FIG. 5B are perspective views of another embodiment of the present invention, in which an apparatus 500 includes a first strap 510 and a second strap 520. In this embodiment, the first strap 510 is configured to loop around the rim portion at the open end of a golf bag 170. The rim portion at the open end of the golf bag 170 may include loops sewn into the surface of the golf bag, within which the first strap 510 is secured when deployed on the golf bag 170. The first and second straps 510 and 520 include coupling components such as a male portion 530 and a female portion 560. In one embodiment, the second strap 520 is coupled to the first strap 510, and includes a buckle 530 at one end 540 thereof. At an opposing end 550, a keeper 560 may be included, so that the second strap 520 can be positioned around a support member of the golf cart and secured by inserting the keeper 560 into the buckle 530. A further adjustment portion 570 may also be included. The further adjustment portion 570 allows a length of the straps 510 and 520 to be increased to accommodate different golf bag sizes and designs and/or different golf cart designs.

The embodiment of FIG. 5A and FIG. 5B may also be included as an accessory that is manufactured as a fixed item on a golf bag 170. In such a case, the first strap 510 may be sewn, riveted, or otherwise fixedly coupled to a surface of the golf bag 170 around the rim portion 174 thereof. The second strap 520 may be coupled at or near the end having the buckle 530 by sewing, riveting, or otherwise attaching it to the first strap 510, to the surface of the golf bag 170 around the rim portion 174, or both.

Figure 6:
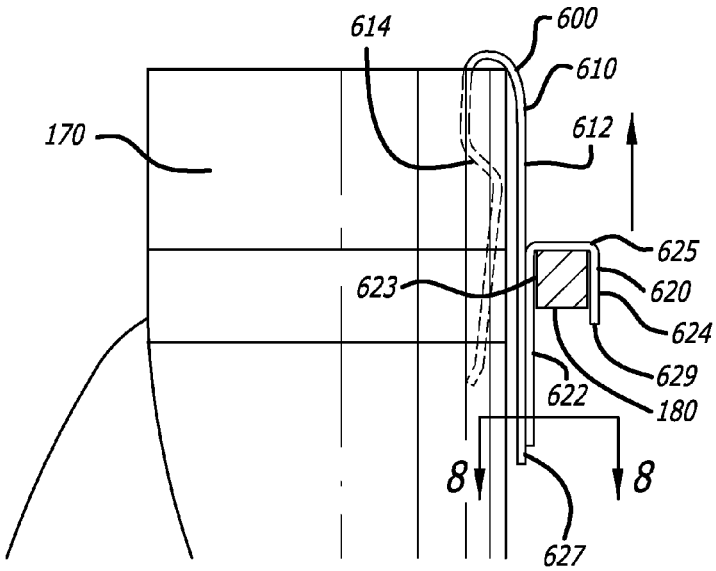
FIG. 6 is a side view of an assembly coupling a golf bag to an attachment member of a golf cart according to still another embodiment of the present invention.
Figure 7:
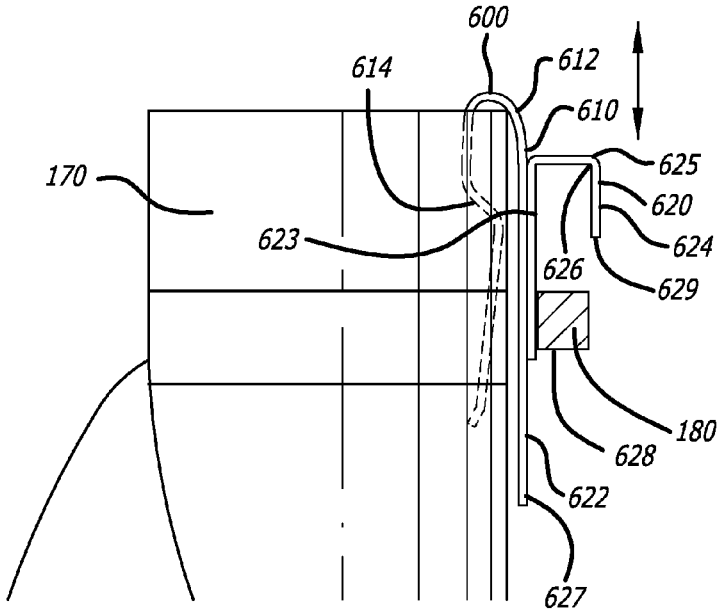
FIG. 7 is a side view of the assembly of FIG. 6 in which a golf bag is uncoupled from an attachment member of a golf cart.

FIG. 6 and FIG. 7 are side views of another embodiment of the present invention, in which an apparatus is a clip assembly 600 comprised of a first elongated body 610 and a second elongated body 620. The first elongated body 610 is configured to be inserted into a golf bag, so that a front side 612 is positioned adjacent to an outside surface of a golf bag, and so that a back side 614 is positioned adjacent to an inside surface of the golf bag 170 as shown in FIG. 6 and FIG. 7. In one aspect of this embodiment, the front side 612 may be substantially straight so as to conform to the shape of the golf bag and not unnecessarily protrude therefrom. The back side 614 may be machined, as in the embodiment of FIG. 1, in a curved manner to form a bias between the front side and back side to secure the first elongated body 610 when in positioned on a golf bag 170. In the embodiment of FIG. 6, the first elongated body 610 is machined so that the front side 612 and the back side 614 form a closed end at a top portion of the first elongated body 610, and an open end at a bottom portion of the first elongated body 610. The space between front and back sides at the top portion may be slightly wider than the gap between front and back sides at the bottom portion. The wider space at the top portion enables the back side to fit over a rim portion 174 at an open end of the golf bag 170.

Figure 8:
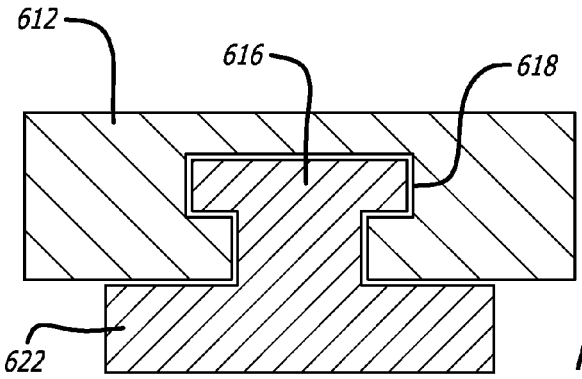
FIG. 8 is a cross-sectional view of the assembly of FIG. 6 and FIG. 7.

The second elongated body 620 is configured to vertically slide, relative to the front side 612 of the first elongated body 610 so that the clip assembly is adjustable to accommodate different sizes of golf bags and different bar heights or other attachment members of various golf cart manufacturers. FIG. 6 shows the clip assembly 600 in coupled state, with the second elongated body 620 deployed to couple the golf bag 17 to an attachment member 180, while FIG. 7 shows the clip assembly 600 in an uncoupled state. Regardless, the front side 612 of the first elongated body 610 may be configured with a recessed portion 618 within which a track 616 in mating side 622 of the second elongated body 620 is adjustably positionable, as indicated in FIG. 8. One or more securing components may also be provided to securely couple the mating side 622 of the second elongated body 620 with the front side 612 of the first elongated body 610 within the recessed portion 618.

Similar to the first elongated body 610, the second elongated body 620 is formed so that the mating side 622, and the cart side 624, formed a closed end 626 at top portion 623 and 625 of the mating side 622 and cart side 624, respectively. At bottom portions 627 and 629 of the mating side 622 and cart side 624, respectively, the second elongated body 620 has an open end 628. The closed end 626 enables the clip assembly 600 to be utilized so that the second elongated body 620 may be positioned over an attachment member 180 of a golf cart. The track 616 and securing components allow the clip assembly 600 to be adjusted, as noted above, to enable the clip assembly 600 to secure any golf bag 170 to any golf cart.

The embodiment of FIG. 6 and FIG. 7 may also be included as an accessory that is in part manufactured as a fixed item on a golf bag 170. FIG. 9 and FIG. 10 show side views of this accessory 700, in which a first elongated body 710 is machined to an outer surface of the golf bag 170 so as to be permanently affixed thereto. FIG. 9 shows an open state of the accessory 700 relative to an attachment member 180, while FIG. 10 shows a closed state relative to the attachment member 180. A second elongated body 720 is configured to couple with the first elongated body 710 via a mating side 722, which couples with a sleeve or opening 718 on the first elongated body 710, and is capable vertically moving in a telescoping manner to accommodate different golf bag sizes and different golf cart configurations. It is to be noted that any means for enabling the second elongated body 720 to mate with the first elongated body 710.

In the embodiment of FIG. 9 and FIG. 10, the first elongated body 710 may alternatively be machined as part of a support spine of the golf bag 170. The first elongated body 710 may therefore be positioned on either an outer surface of a golf bag 170, or an inside surface thereof, so that the first elongated body 710 is machined to be fixedly attached inside the golf bag 170. Regardless, the second elongated body 720 is formed so that the mating side 722, and a cart side 724, formed a closed end 726 at top portion 723 and 725 of the mating side 722 and cart side 724, respectively. At bottom portions 727 and 729 of the mating side 722 and cart side 724, respectively, the second elongated body 720 has an open end 728. The closed end 726 enables the clip assembly 700 to be utilized so that the second elongated body 720 may be positioned over an attachment member of a golf cart. Furthermore, one or more securing components may also be provided to securely couple the mating side 722 of the second elongated body 720 with track, sleeve, or opening of the first elongated body 710.

In another embodiment of the present invention, a method of manufacturing a clamping mechanism embodied in an apparatus 100 is contemplated. The method comprises machining a member having an elongated body into front and back sides, a curved upper portion at a closed first end between the front and back sides, and tapered lower portions at an open second end of the front and back sides. The front side configured to be positioned on an outside surface of a golf bag, and the back side configured to be positioned on an inside surface of the golf bag, when inserted therein.

In this embodiment, a plurality of curvatures are molded on the front and back sides to accommodate one or more contours of the outside surface and the inside surface of the golf bag. This has the effect of creating bias between the front and back sides to enable tension to secure the golf bag when coupled to a golf cart once the member is inserted into the golf bag. The plurality of curvatures are designed with respect to the one or more contours of the golf bag to reduce damage caused by the tension to either of the outer surface or inner surface of the golf bag.

Such a method of manufacturing also includes coupling a strap assembly to an outer surface of the front side of the member to enable coupling of the golf bag to the golf cart.

In this embodiment, the strap assembly is machined to the outer surface in at least two positions on the outer surface, and further includes an adjustment mechanism allowing any golf bag to be securely coupled to one or more fixed members of any golf cart.

As noted above, the present invention is applicable as an accessory or factory-included article to a golf bag having a housing that is comprised of a multi-tiered rack system. The multi-tiered rack system enables the golf bag to expand so that compartments within each rack are open and contents are easier to remove and replace. The multi-tiered rack system includes a first rearwardly-disposed rack, integrally formed with the housing, and adapted to receive and cover a golfing equipment, such as for example "wood" clubs. The multi-tiered rack system also includes second and third racks, each pivotally connected to a housing base, and adapted to receive other golf equipment, such as for example "iron" clubs and "wedge" clubs, respectively. The first and second racks may comprise a base tray having a plurality of open-faced grooves, recesses or slots, wherein the open-face of each groove or slot is preferably covered via resilient fabric, or the like, for effectuating an outer retaining wall thereover. Each slot of the first and second rack trays may be dimensioned to retain the upper-most portion of the handle of a golf club, so that forward dislodgement of the club handle from a respective slot is precluded via the outer fabric retaining wall affixed thereover. The third rack may also possess a base tray, which may be functionally and substantially structurally equivalent to the base trays of the first and second rack.

The present invention is designed to be disposed on a rear side of the housing, opposing the side to which the multi-tiered rack system expands, for facilitating engagement of the golf bag to one or more attachment members of a golf cart. Such a configuration permits the golf bag to extend beyond the rear of the golf cart and provide free frontal access to the contents thereof without having to remove the golf bag from the golf cart itself.

The present invention may further include one or more spring mechanisms that are included at or substantially near the closed, upper portion end 120. Such spring mechanisms may be actuated by a handle or other gripping mechanism. Regardless, such a spring mechanism may be used to disengage the tension in the apparatus of the present invention to enable a user to apply it to a golf bag, or remove it therefrom.

The foregoing descriptions of embodiments of the present invention have been presented for the purposes of illustration and description. It is not intended to be exhaustive or to limit the invention to the precise forms disclosed. Accordingly, many alterations, modifications and variations are possible in light of the above teachings, may be made by those having ordinary skill in the art without departing from the spirit and scope of the invention. It is therefore intended that the scope of the invention be limited not by this detailed description. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense, it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

The invention claimed is:

1. A clip assembly for a golf bag, comprising:

a member molded to form a back side and an opposing front side that is slightly elongated relative to the back side, with a closed end formed at upper portions of the front and back sides, and an open end formed at lower portions of the front and back sides, the member having angular sections on each of the front and back sides that include a top angled portion and a bottom angled portion along the front side, and a back angled portion along at least a section of the back side, the front and back sides each being tapered at the open end and having a tension formed between them to accommodate insertion, secure placement, and removal of the member relative to a golf bag; and recessed cavities positioned within thicker portions in the top and bottom angled portions on the front side having a thickness greater than the upper portion and the lower portion of the back side, so that a first recessed cavity is formed within a top angled portion of the front side, and a second recessed cavity is formed within a bottom angled portion of the front side, each of the top and bottom angled portions also having 1) an outer portion partially enclosing each recessed cavity, 2) a plurality of teeth extending out angularly near an end of each outer portion and towards each thicker portion that engage with at least one strap of a strap assembly to prevent at least one strap member from disengaging from the clip assembly when the golf bag is coupled to a golf cart, 3) an inner aperture within each thicker portion within which the at least one strap member is positioned, and 4) an open side within which a securing portion of the strap assembly is insertable and lockable therein.

2. The clip assembly of claim 1, wherein the outer portion, the plurality of teeth, and the inner aperture of each of the top and bottom angled portions securely hold the securing portion within each recessed cavity when the strap assembly is deployed to couple a golf bag to one or more fixed members of a device.

3. The clip assembly of claim 2, wherein the one or more fixed members of a device comprise a basket configured on a golf cart.

4. The clip assembly of claim 1, wherein the closed end formed at upper portions of the member enables fitting of the clip assembly so that when inserted into an open end of a golf bag, the member fits securely over the outer rim of the golf bag without causing damage to the golf bag or its contents.

5. The clip assembly of claim 1, wherein each outer portion of the top and bottom angled portions has a slope which narrows an opening at the end of each outer portion so that the plurality of teeth hold the securing portion of the strap assembly in place.

6. The clip assembly of claim 1, wherein the strap assembly includes a male portion and a female portion.

7. An apparatus comprising:

a clipping assembly having a member molded to form a back side and an opposing front side that is slightly elongated relative to the back side, with a closed end formed at upper portions of the front and back sides, and an open end formed at lower portions of the front and back sides, the front and back sides each being tapered at the open end and having a tension formed between them to accommodate insertion, secure placement, removal of the member relative to a golf bag, and prevent lateral and vertical movement of the apparatus while the member is positioned in the golf bag;

a plurality of curved portions formed in the member that include a front curved portion along a section of the front side and a back curved portion along a section of the back side to accommodate one or more contours of a golf bag and create one or more points of pressure at inside and outside surfaces of the golf bag; and a strap assembly coupled to the clipping assembly in at least one position along an outer surface of the front side, the strap assembly having a coupling portion and an adjustment mechanism allowing the strap assembly to be opened, closed and adjusted relative to one or more fixed members of a device to which the golf bag is coupled.

8. The apparatus of claim 7, wherein the coupling portion is comprised of a buckle and keeper.

9. The apparatus of claim 7, wherein the strap assembly is further comprised of two strap portions, a first strap portion coupled to the front side at an upper position along the outer surface of the front side, and a second strap portion coupled to the front side at a lower position along the outer surface of the front side.

10. The apparatus of claim 7, wherein the points of pressure and the tension enable the first member to securely fit over the outer rim of the golf bag without causing damage to the golf bag or its contents.

11. The apparatus of claim 7, wherein the one or more fixed members of a device comprise a basket configured on a golf cart.

* * * * *